United States Patent [19]

Takeshita

[11] Patent Number: 4,531,909

[45] Date of Patent: Jul. 30, 1985

[54] HANDLING SYSTEM FOR IC DEVICE

[75] Inventor: Osamu Takeshita, Hikone, Japan

[73] Assignee: Dainippon Screen Mfg. Co., Ltd., Kyoto, Japan

[21] Appl. No.: 549,450

[22] Filed: Nov. 4, 1983

[30] Foreign Application Priority Data

Nov. 29, 1982 [JP] Japan ..... 57-181402[U]

[51] Int. Cl.[3] ..... F27B 9/40; F27D 19/00

[52] U.S. Cl. ..... 432/37; 414/147; 414/158; 432/33

[58] Field of Search ..... 432/33, 37; 414/147, 414/158; 29/742, 743

[56] References Cited

U.S. PATENT DOCUMENTS 4,283,847 8/1981 May ..... 29/742

4,393,579 7/1983 Hooreweder ..... 29/743

*Primary Examiner*—John J. Camby

*Attorney, Agent, or Firm*—Brumbaugh, Graves, Donohue & Raymond

[57] ABSTRACT

There is provided a handling system for IC devices having a guide stage comprising a bank portion in which both sides of a IC device to be tested are held at a position other than a portion where terminals of the IC device project and a vacuum suction pore which suctorially sticks to the underside of the IC device at the midpoint of the bank portion.

There is also provided a handling system for IC devices wherein multiple bank portions are provided on the stage, one half of which is used for carrying IC devices and the remaining half of which is used for discharging IC devices.

13 Claims, 7 Drawing Figures

HANDLING SYSTEM FOR IC DEVICE

BACKGROUND AND SUMMARY OF THE INVENTION

The present invention relates to a handling system for an integral circuit (IC) formed by plastic molding and packaged into a flat package type IC (hereinafter called an "IC device"), and more particularly to a handling system for an IC device preferable for bringing an IC device into contact with a test head of an IC tester.

The said IC device is formed into a square flat plate in which a number of terminals are projected in parallel with each other on one side or both sides of the IC device respectively, and is relatively small in size having pin-like terminals being fine compared with a dual inline package type IC (generally called "DIP"). Accordingly, as the said terminals are apt to be bent easily during handling thereof causing a serious problem to the conveyance and to the automatic positioning, when characteristics of an IC device are measured or tested the process of contact with the test head is obliged to be performed manually in most of the cases.

In recent years, according to the increase of the request or demand for variety of IC functions, the number of terminals as well as the density of integration have increased, and it is now generally recognized that the flat package type IC device is more fitted for or satisfactory to the said demand than the DIP type IC device. Consequently the said flat package type IC has been increasingly mass-produced, and in order to improve the productivity thereof, there is strong demand for a handling system of IC devices which permits an automatic contact of a IC device to be tested with a test head of IC tester by means of automatic conveyance, automatic positioning, etc.

It is, therefore, an object of the present invention to provide a handling system for IC devices so that an IC device may be quickly brought into contact with the test head of the IC tester without causing such damage as bending to the terminal, thereby satisfying the foregoing demand.

Thus, in accordance with the present invention, there is provided a handling system for IC devices having a guide stage for an IC device comprising bank portions in which both sides of an IC device to be tested are held at a position other than a portion where terminals of the IC device are projected, and wherein a vacuum suction pore is provided which suctorially sticks to the underside of the IC device at the midpoint of the said bank portions.

It is a further object of the present invention to provide a handling system for IC devices having the following advantages and features when characteristics of an IC device are measured and tested by bringing the same into contact with the test head of the IC tester:

(i) By providing, on the surface of a stage, several square portions, i.e., enclosures or recess portions in which each IC device to be tested is accommodated and positioned at the portion other than the projecting portion of terminals arranged on the side thereof in a manner not to interfere said terminals, so that each of the terminals of the IC device can be brought into contact with a contact pin of the IC tester through the stage while the same remains in said enclosure or recess portion being supported on the upper surface of said enclosure or on the surface of said stage, with an appropriate contact pressure maintained and without causing any bending. In this manner, the conventional manual setting by hand is no longer necessary and an exact measurement can be carried out eliminating the induction of noise even when the measurement is in the high frequency area, since the contact is made in direct manner.

(ii) By providing, on the surface of the stage, said bank portions, i.e., the enclosures or the recess portions symmetrically with respect to the rotation center of the stage respectively as the said guide stage is rotatable, during the period between the second test and the test i immediately before the final test, carrying of an IC device yet to be tested as well as discharging of a tested IC device to and from the enclosure or recess portion on the surface of the stage can be made concurrently. Further, when the characteristics of IC devices are measured, multiple units of IC devices can be simultaneously measured, thereby improving the productivity of IC devices.

(iii) By providing, on the surface of the stage, said bank portions adapted to the molded configuration of the IC device and a vacuum absorption pore, the positioning for holding the IC device can be exactly made.

Other objects, features and advantages of the present invention will become apparent in the course of the following description with the accompanying drawings.

BRIEF DESCRIPTION OF THE DRAWINGS

In the accompanying drawings, forming a part of the present invention, and in which like parts are designated by the reference numerals and characters throughout the same.

DESCRIPTION OF THE PREFERRED EMBODIMENTS

Figure 1:
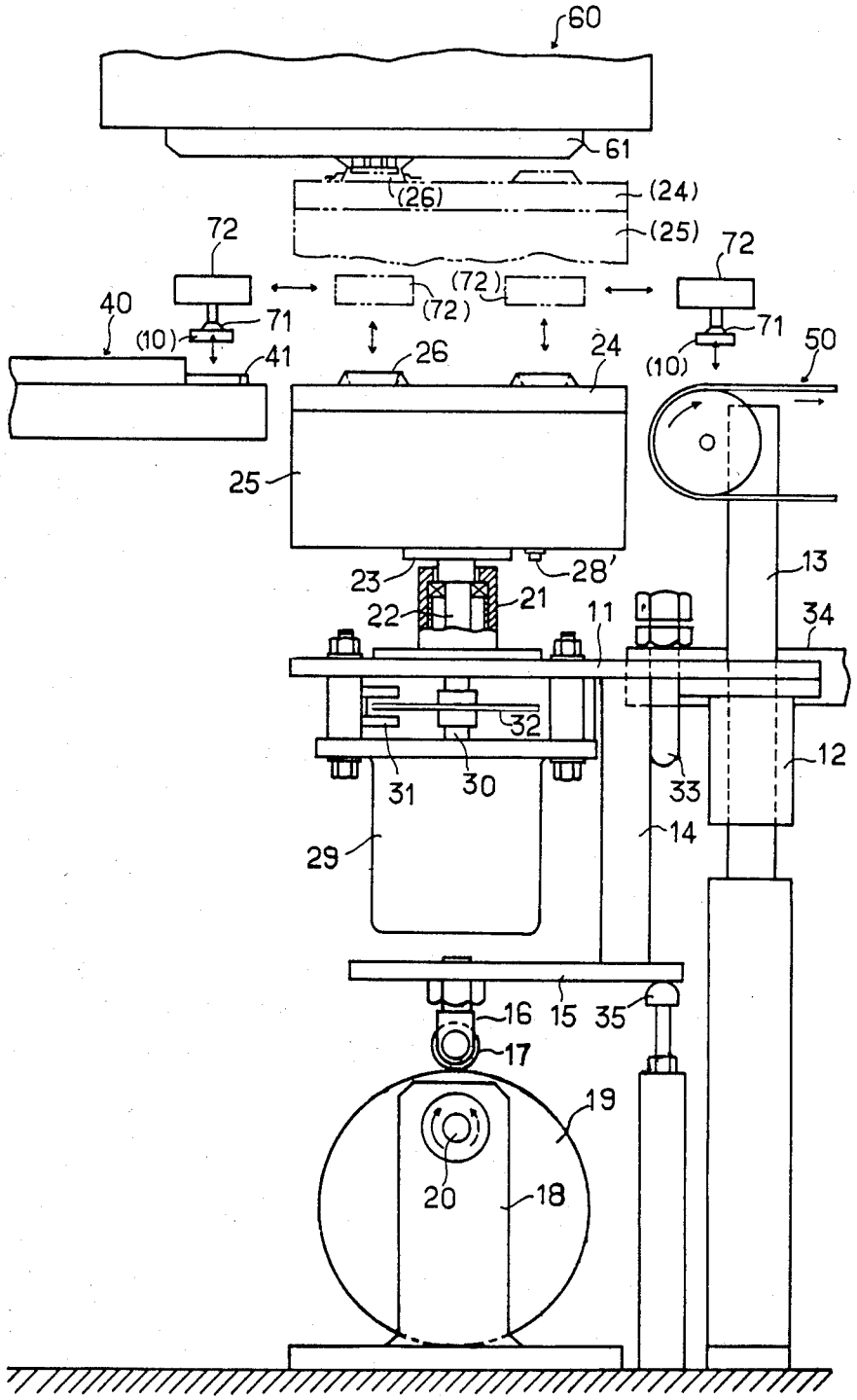
FIG. 1 is a side view of a handling system for an IC device embodied in accordance with the present invention (a part of an IC tester is shown on the upper side, a part of heating element on the left side, and a part of a discharging conveyor on the right side, respectively).

Referring now to FIG. 1, a side view of a handling system, there is shown a part of a test head 60 on the upper side, on the left side a part of a heating element 40 for heating an IC device to be tested up to a guaranteed temperature being one of the requirements on measuring characteristics of the IC device, and a part of a conveyor 50 for discharging the IC device whose characteristics have been already measured on the right side.

A square base plate 11 the outside portion of which is extended to the right like an arm, is slidably mounted on a pair of vertical guide rods 13 through a guide support 12 respectively fixed to the lower side of an end of said outside portion, and is connected to an actuating plate 15 at the position of a little to the right side from the center through a pair of connecting members 14. A roller (cam follower) 17 is rotatably supported or pivoted on a support bracket 16 fixed to the said actuating plate 15, and the said roller 17 comes into contact with an eccentric disc cam 19 rotatably supported or pivoted on a bearing stand 18.

A rotary shaft 20 fixed to said eccentric disk cam 19 is connected to a rotary actuator of pneumatic drive (not illustrated), by which said rotary shaft 20 is rotated clockwise by 180° as indicated by the solid lined arrow giving a counter-clockwise rotation to the roller 17 so that said roller may be lifted during the counter-clockwise rotation, whereby the actuating plate 15 is lifted and, in turn, the base plate 11 is vertically pushed up or lifted from its lowered position along with a pair of guide rods 13 through the connecting members 14 connected to the actuating plate 15.

Figure 2:
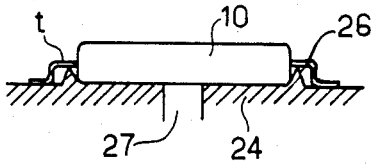
FIG. 2 is a partially sectional view of a stage showing the IC device accommodated in the enclosure provided on the stage.

On the base plate 11, there is provided a rotary shaft 22 rotatably supported thereon through a bearing stand 21 fixed to the center of the base plate 11, and a cylindrical box 25, having a disc stage 24 thereon is fixed to the upper end portion of a rotary shaft 22 through a support joint 23. On the said disk stage 24, symmetrically with respect to the center (O) of the rotation (hereinafter called as "rotation center (O)", there are provided square enclosures (or bank portions) 26 respectively for accommodating each IC device 10 for inspection and for positioning the same as shown in the plan view of FIG. 4. Each of the said square enclosures 26 is, as shown in FIG. 2, trapezoidal in section and the inside of which is so formed as to be adapted to the molded configuration of the IC device, so that the IC device 10 accommodated and positioned therein may be easily carried therein and that when the bottom part of the IC device 10 is set on the stage 24, the IC device 10 may be held at a position lower than the projecting portion of a terminal (t) being projected on the side of the IC device 10 and whose end portion is bent along with the bottom face of the IC device 10, thereby preventing the said terminal (t) from the interference by the top face of the enclosure 26 or by the upper surface of the stage 24.

Figure 5:
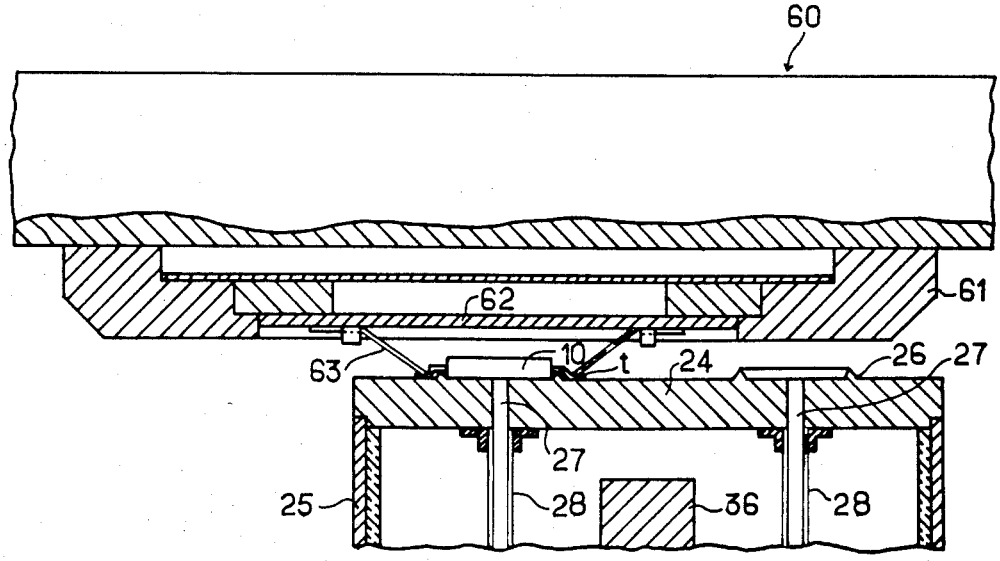
FIG. 5 is a partially sectional view of the stage and the IC tester showing the state of contact of the IC device with a probe card by the handling system.

On the center of the said enclosure 26, in order to guide the IC device 10 having a small dead weight into the enclosure 26 and to secure the same onto the stage 24 for positioning, there is provided a vacuum suction pore 27 to which, as shown in FIG. 5, a suction pipe 28 is connected. The said suction pipe 28 is connected with a vacuum pump (not illustrated) through a flexible tube connected with the coupling member 28'.

The rotary shaft 22 for the stage 24 is directly coupled with a shaft 30 of a motor 29 hanging from the base plate 11, and a disk plate 32 for controlling the rotational position is attached to the shaft 30. A photo sensor 31 comprising a light emitting portion and a light receiving portion is actuated for the stop control of the motor 29 so that the rotational position of the stage 24 may be defined. On the circumference of the said disk plate 32 corresponding to an optical path of the photo sensor 31, there are provided a pair of pores 180° apart. When one of the said pores coincides with the optical path of the photo sensor 31, the motor 29 starts and the shaft 30 together with said disk plate 32 rotates, until the other of said pores coincides with the photo sensor 31, whereupon the motor 29 stops.

Figure 4:
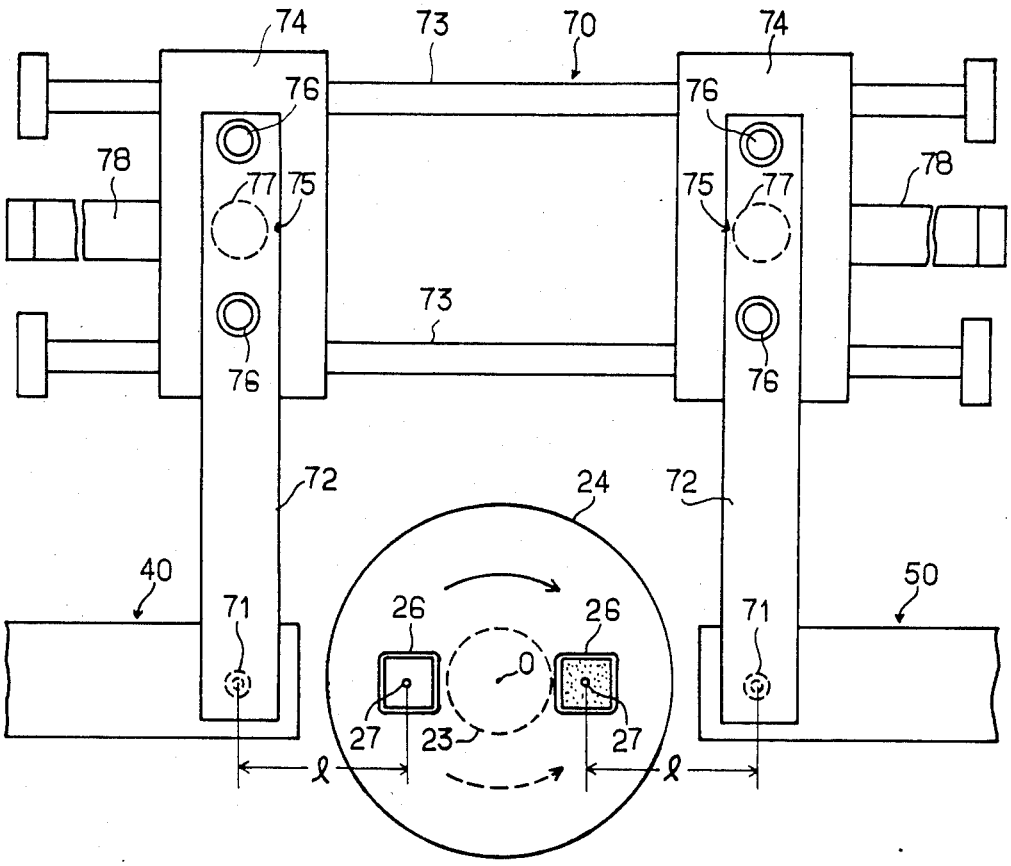
FIG. 4 is a plan view of the stage of the handling system as well as a carrier system provided together with the handling system.

In this manner, as shown in FIG. 4, by adjusting beforehand the required angular position with respect to the shaft 30 of the said disk plate 32, the position of the enclosure 26 can be rotated by 180° so that the position may be interchanged between left and right.

As described above, by rotating clockwise the rotary shaft 20 of the eccentric disk cam 19 as indicated by the arrow of solid line, the stage 24 is lifted together with the base plate 11. In order to control the lifted position to the predetermined level or height, there is provided a lifted position control stopper 33 on an arm 34 projecting in the form of cantiliever from the fixed part (not illustrated) to the halfway of the said arm-like portion of the base plate 11, thereby allowing the height of the bottom face of the arm 34 to be adjusted beforehand.

In this embodiment, when the stage 24 is lifted up to the position indicated by the phantom line in FIG. 1, the bottom face of the said stopper 33 comes into contact with the upper surface of the actuating plate 15 and the rotary shaft 20 is forcedly stopped against the clockwise torque given thereto from the pneumatic rotary actuator so that the stage 24 may be held at the said lifted position.

On the other hand, when the stage 24 is to be lowered from the foregoing lifted position down to the position indicated by the solid line of FIG. 1, the rotary shaft 20 is rotated counter-clockwise by the said rotary actuator as indicated by the arrow of dotted line, and in order to control the lowering down to the said position, there is provided a lowered position control stopper 35 so that the stage 24 may be stopped and held at the predetermined lowered position. The said contol stopper 35 comes into contact with the bottom face of the actuating plate 15 so as to stop and hold the stage 24 at the said lowered position against the weight of each member loaded on the stage 24. The height of the upper face of the arm 34 can be adjusted beforehand in a similar manner as the lifted position control stopper 33.

In the embodiment shown in FIG. 1, there is also provided on the left side of the handling system, a heating element 40 whose height is coincident with the stage 24 when held at the lowered position, and on the right side of the system a discharging belt conveyor 50 whose height on the carrying surface is also coincident with the stage 24, and further on the upper side of the system a test head 60, which as a whole illustrate the system used for bringing the IC device 10 into contact with the test head 60. The said heating element 40 is provided so as to measure characteristics of the IC device 10 under the guaranteed temperature, and to this effect, on the said heating element 40 there is provided a temperature control unit comprising a temperature sensing element for controlling an electric heater or the heating element 40 at the predetermined temperature.

Accordingly, in this embodiment, as shown in FIG. 5, inside the cylindrical box 25 on which the stage 24 is mounted, there is also provided a heater 36 and the same temperature control unit as described above (not illustrated) so as to maintain the stage 24 at the predetermined temperature. A a heat insulating material is placed on the inner wall of the box 25.

Further, as shown in FIG. 4, there is provided a carrier system 70 by which an IC device 10 to be tested is carried from the said heating element 40 to the stage 24 to be accommodated in the enclosure 26, while a tested IC device 10 already inspected on the test head 60 is taken out of the enclosure 26 of the stage 24 and carried to a discharging belt conveyor 50.

The said carrier system 70 is arranged symmetrically on the stage 24 of the handling system of this embodiment and comprises a carrier arm 72 having a suction member 71 on the underside thereof, a carriage 74 sliding along with a pair of guide rails 73 so as to move said carrier arm 72 reciprocatingly within the distance (l) indicated in FIG. 4, and a vertical movement mechanism 75 fixed to the carrier arm 72 with the levelness thereof maintained. There is also shown in FIG. 4 a pair of guide rods 76 fixed to the carriage 74, an air cylinder 77 for the vertical movement of the carrier arm 72, and an air cylinder 78 for the transversal or horizontal movement of the said carriage 74.

Referring now to the method of contact of the IC device 10 with the test head 60, when the IC device 10 to be tested is intermittently fed to the heating element 40 and positioned by a positioning pin 41, the carrier arm 72 on the left side of the carrier system 70 descends or is lowered and the suction member 71 thereon suctorially sticks to the IC device 10 which, as it remains sticked, is pressed against the surface of a heating plate for a while to get heated up to the guaranteed temperature. After being heated, the IC device 10 is lifted by the carrier arm 72 with said suction member 71 stick as indicated by the two-dot chain line of FIG. 1, and when the IC device 10 is carried right above the enclosure 26 on the stage 24 by the horizontal movement of the carrier arm 72 by a distance (l) to the right, said carrier arm 72 descends and places the IC device 10 on the enclosure 26 as shown in FIG. 2. At this moment the vacuum of the suction member 71 is broken, and the vacuum suction pore 27 provided on the center of the enclosure 26 is activated, the IC device 10 accommodated in the enclosure 26 is tightly secured to the surface of the stage 24. Then the carrier arm 72 ascends or is lifted to the position indicated by the two-dot chain line and moves horizontally by the said distance (l) to the left to return to the waiting position above the heating element 40.

As the stage 24 is kept at the guaranteed temperature beforehand, the IC device 10 accommodated in the enclosure 26 and tightly secured to the surface of the stage 24 is also kept at the guaranteed temperature. Then by the actuation of the said rotary actuator, the rotary shaft 20 of the eccentric disc cam 19 is rotated clockwise and the stage 24 is lifted to the predetermined position indicated by the phantom line (FIG. 1) to be held there.

As shown in FIG. 5, when the stage 24 is held at the predetermined lifted position as described above, each of the terminals (t) of the IC device 10 comes in contact with a corresponding contact pin 63 which project in cantilever fashion obliquely downward from a probe card 62 attached to a probe card attaching portion 61 of the test head 60 so as to be contacted by the appropriate contact pressure.

The foregoing contact is assured so long as the terminal (t) of the IC device 10 is supported on the upper surface of the enclosure 26 and the surface of the stage 24 is kept with an appropriate space from the probe card attaching portion 61 by adjusting the lifted position control stopper 33. The position of the probe card 62 is adjusted beforehand by an adjustment mechanism (not illustrated) provided inside the probe card attaching portion 61, thereby to ensure that respective contact pins 63 come into contact with corresponding terminals (t) of the IC device 10.

In this manner the characteristics of IC are measured by the direct contact between the contact pin 63 of the test head 60 and the terminal (t) of the IC device 10. According to the test made by this direct contact, compared with the conventional method by means of a cable, the induction of noise is substantially eliminated particularly in the high frequency area, so that the measurement can be exactly carried out accurately.

When the predetermined measurement is completed, the stage 24 descends to the predetermined lowered position and is held there. Then the motor 29 starts, and after rotating the stage 24 clockwise by 180 as indicated by the arrow of the lolid line, the motor 29 stops so that the stage 24 is held at this rotated position.

Now the tested IC device 10, carried by the discharging conveyor 50 and accommodated in the enclosure 26 indicated by the grain pattern in FIG. 4, is suctorially held by the suction member 71 during the horizontal movement and the descending of the carrier arm 72. More particularly the said carrier arm 72 moves to the left by the distance (l) and descends to the predetermined position for the suction, and then said IC device 10 is put on the discharging conveyor 50 by the reverse operation of the carrier arm 72 and the vacuum of the suction member 71 is broken so that the IC device 10 may be discharged by the conveyor 50.

When the suction member 71 suctorially sticks to the tested IC device 10, the suction by the vacuum suction pore 27 of the enclosure 26 on the stage 24 is deactivated.

Concurrently with the carrying operation for the tested IC device 10 from the stage 24 to the conveyor 50 as described above, the next IC device 10 to be tested is carried from the said heating element 40 to the stage 24 by the carrier arm 72 arranged on the left side of the carrier system 70.

Thus, one after another, testing IC devices 10 are brought into contact with the test head 60 and, after being tested or measured, are put on the discharging conveyor 50 to be transferred to next process.

In case that the measurement of the IC device 10 by the IC tester takes the most of the time of the test cycle, it may be difficult to reduce the measuring time itself for the individual IC device 10. However, by appropriately arranging multiple probe cards 62 on the test head 60 in a manner so as not to interfere with the contact pin 63, and further by providing additional enclosures 26 on the stage 24 corresponding to the foregoing multiple arrangement of the probe card 62, multiple units of IC devices 10 can be simultaneously measured or tested, thereby increasing the number of IC devices tested per unit time or improving the productivity of the IC device.

Figure 6:
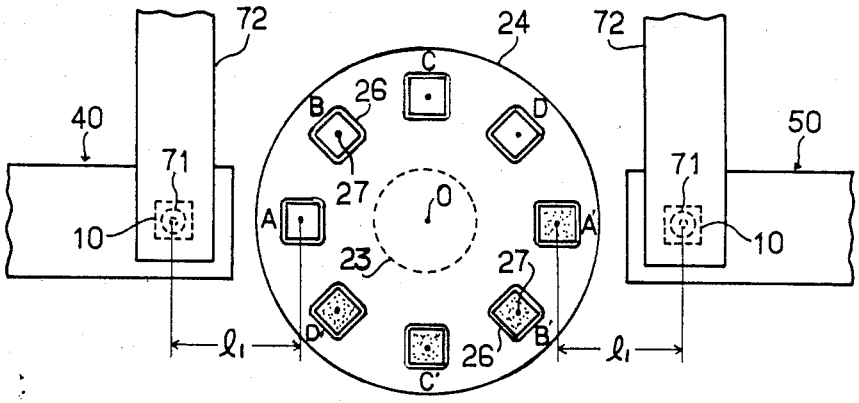
FIGS. 6 and 7 are plan views of the stage, respectively, showing an example of the arrangement of the enclosure provided on the surface of the stage for the accommodation of the IC device.
Figure 7:
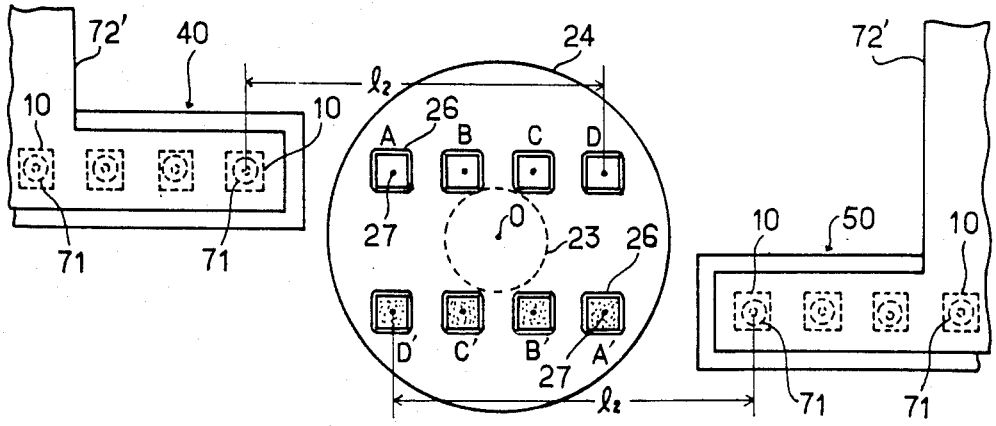

FIGS. 6 and 7 refer to each of the examples of said multiple arrangement of enclosures 26 on the stage 24.

Referring first to FIG. 6, an even number of enclosures 26 (8 units in this example) provided, each accommodating and holding a different IC device 10, are arranged on the stage 24 symmetrically with respect to the rotation center (O), i.e., at the equal angle (45° in this example) on the same circumference. On the stage 24 the IC device 10 positioned at the predetermined position and heated at the guaranteed temperature is first accommodated in the enclosure 26 situated at the position A by the operation of the carrier arm 72 arranged on the left side and of the suction member 71 as described above. Another IC device 10 is inputted and treated in the heating element 40 is accommodated in the enclosure 26 situated at the position B after counter-clockwise rotation of the stage 24 by 45°. By repeating the same operation, yet additional IC devices 10 are accommodated in the enclosures 26 situated at the positions C and D, respectively.

In the arrangement where test head 60 has multiple probe cards 62, corresponding contact pins 63 are positioned corresponding to each of the positions A', B', C', D' indicated by the grain pattern in FIG. 6. By rotating the stage 24 counter-clockwise by 45°, so as to be restore the stage 24 to the original position as shown in FIG. 6, and by lifting and holding the stage 24 to the said predetermined (lifted) position, 4 units of IC devices 10 can be simultaneously measured by the IC tester. When the measurement is completed the stage 24 is lowered to the predetermined (lowered) position, and the tested IC device 10 is carried from the enclosure 26 at the position A' to the discharging conveyor 50 by the carrier arm 72 arranged on the right side and by said suction member 71. The tested IC device 10 is then carried from the enclosure 26 at the position B' to the discharging conveyor 50 by the counter-clockwise rotation of the stage 24 by 45°. By repeating the same operation, the tested IC devices 10 are also carried from the enclosure 26 situated at the positions C' and D' to the discharging conveyor 50.

Concurrently with the foregoing carrying operation for the tested IC device 10 from the stage 24 to the discharging conveyor 50, another testing IC device 10 is carried from the heating element 40 to the stage 24 as described.

Accordingly, in the handling system having the stage 24 of FIG. 6, before the test is started the testing IC devices 10 are carried to half of the enclosures 26 (i.e. A, B, C and D) on the stage 24, and when the test is completed, the tested IC devices 10 are discharged from or taken out of the same number of enclosures 26 (4 units in this example) one after another. In the course of the foregoing process, the carrying operation is performed simultaneously with the discharging operation for the IC devices 10 to and from the same number of enclosures 26 (4 units in this example) one by one. Thus, multiple units of the IC device 10 in the same number (4 units in this example) can be simultaneously measured by the IC tester.

Consequently, on the stage 24 of FIG. 6, where the measuring of the IC device 10 by the IC tester takes more time compared with the time necessary for the carrying operation between the heating element 40 and the stage 24, and the discharging operation between the stage and the discharging conveyor 50, the productivity of IC devices is considerably improved.

Referring now to the FIG. 7, 8 units of enclosures 26 for the accommodation of IC devices 10 are provided on the stage 24 symmetrically with respect to the rotation center (O). In particular, the enclosures 26 are positioned in other wards, oppositely at a certain pitch on the parallel lines equidistant from the rotation center (O). In like manner, four probe cards 62 of the test head 60 are arranged corresponding to each of the positions A', B', C', D' of the enclosures 26 on the stage 24. Each carrier arm 72', 72' arranged on both sides of the carrier system 70 is formed in L-type or inverted L-type at the end portion thereof, in which the suction members 71 are arranged in the same number and pitch as the enclosures 26. The heating element 40 and the discharging conveyor 50 are offset by a equal distance from the rotation center (O) on the stage 24, so that the heating element 40 is coincident with the center line of the positions A, B, C, D, while the discharging conveyor 50 is coincident with the center line of the positions A', B', C', D'.

By the foregoing formation or arrangement, in the handling system of FIG. 7, when the test is started the IC devices 10 are simultaneously carried to one half of the enclosures 26 situated at the positions A, B, C, D on the stage 24, and when the test is completed the IC devices 10 are simultaneously discharged from or taken out of the same number of enclosures 26 situated at the positions A', B', C', D'. In the course of the foregoing process, the carrying operation for the IC devices 10 as well as the discharging operation to and from the same number of enclosures 26 (4 units in this example) are simultaneously carried out. The same number of units of IC devices 10 (4 units in this example) are also simultaneously measured by the IC tester.

Consequently in case of the stage 24 of FIG. 7, the distance (l2) of the horizontal movement to the left and the right of the carrier arm 72 arranged on both sides of the carrier system 70 comes to be longer than the distance (l) of FIG. 4 and the distance (l1) of FIG. 6. However, the number of the IC devices 10 tested per unit time can be increased by this modification.

Figure 3:
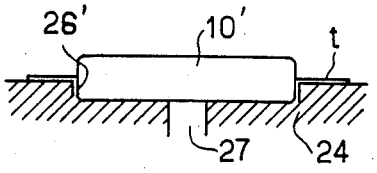
FIG. 3 is a partially sectional view of the stage showing a recess portion thereof in which the IC device whose terminal configuration is different from the IC device of FIG. 2 is accommodated.

The above description is mainly based on an IC device 10 whose terminal (t) has a configuration shown in FIG. 2. In the case of an IC device 10' whose terminal (t) is projected in parallel to the bottom face of the IC device 10' from one side or both sides of the IC device 10' as shown in FIG. 3, it is preferred to provide an angular recess portion (bank portion) 26' at the position of the enclosure 26 on the stage 24 in which the IC device 10' is accommodated in a manner not to be interfered by the portion lower than the terminal projecting portion.

In case that these different types of IC devices 10 and 10' are brought into contact with the test head 60 to measure or test the characteristics thereof, the operation is satisfactorily carried out by providing a stage 24 and a probe card 62 on the test head 60 corresponding to the testing IC device 10 or 10' to be tested.

Further, the motor 29 in the handling system embodied referring to FIG. 1 is also replaceable with the rotary actuator, and in this case the angular position of rotation can be preferably adjusted by an appropriate projection provided thereon.

It is also preferred to compose a vertical movement mechanism by using a close couple air cylinder in place of the mechanism 75 composed of the eccentric cam 19 and the cam follower 17.

It will be evident to those skilled in the art that the present invention is not limited to the details of the foregoing illustrative embodiments, and that the present invention may be embodied in other specific forms without departing from the essential attributes thereof, and it is therefore desired that the foregoing embodiments be considered in all respects as illustrative and not restrictive, reference being made to the appended claims rather than the foregoing description, and all changes which come with the meaning and the range of equivalency of the claims are therefore intended to be embraced therein.

What is claimed is:

1. A system for handling IC packages, comprising:

a substantially flat and horizontally disposed stage platform having means for holding at least one IC package on said state platform;

means for reciprocatingly moving said stage platform vertically between an upper position and a lower position;

means for loading IC packages onto said stage platform into said IC holding means when said stage platform is at said lower position;

testing means for testing at least one IC package on said stage platform when the stage platform is in the upper position;

drive means for rotating said stage platform about its center;

means for unloading at least one IC package off said stage platform after the stage platform is rotated and after the IC package has been tested; and control means for sequentially controlling the means for loading and the means for unloading the IC package, and the means for reciprocatingly moving and means for rotating the stage platform.

2. The IC handling system according to claim 1 wherein the stage platform has means for holding at least two IC packages thereon at symmetrically opposite positions relative to the stage platform center, and wherein the control means controls the loading means to load an IC package to be tested at one of said IC holding positions substantially concurrently with controlling the unloading means to unload an IC package after it is tested at the other of said IC holding positions.

3. The IC handling system of claim 1 wherein the stage platform has a vacuum suction hole at the center of the bottom of the means for holding at least one IC package, and wherein means for creating a vacuum at said suction hole are provided, and wherein the control means controls the vacuum creating means to create a vacuum after an IC is loaded at the IC holding position to thereby hold the IC in place, and for extinguishing said vacuum after stage platform rotation and before the means for unloading is actuated.

4. The IC handling system of claim 1 further including a heater and a temperature detector and controller for heating said stage platform and for keeping the stage platform at a predetermined IC testing temperature.

5. The IC handling system according to claim 1 wherein the stage platform has means for holding a plurality of IC devices.

6. The IC handling system according to claim 5 wherein the IC holding means are arranged in a circular fashion generally equidistantly from each other around the center of the stage platform.

7. The IC handling system according to claim 5 wherein the IC holding means comprise IC holding receptacles arranged in two generally parallel rows on opposite sides of the stage platform.

8. The IC handling system according to claim 7 wherein the means for loading the IC packages onto the stage platform comprises means for simultaneously loading IC packages to be tested into IC receptacles in one of said parallel rows, and wherein means for unloading the IC packages off said stage platform comprises means for simultaneously unloading tested IC packages from receptacles in the other of said parallel rows.

9. The IC handling device according to claim 1 wherein the IC testing means comprises means for testing a plurality of IC packages simultaneously.

10. The IC handling system according to claim 1 wherein the means for holding at least one IC package comprises a recess having a depth approximately equal to the distance that terminals of the IC package are displaced from one side thereof, so that the IC package can be placed in said recess with the said one side facing downward and so that the IC terminals can extend onto the stage platform outside of the recess for an IC package having substantially straight terminals.

11. The IC handling system according to claim 1 wherein the means for holding at least one IC package comprises a recess formed in said stage platform by a peripheral wall having a height approximately equal to the distance that terminals of the IC package are displaced from one side thereof, so that the IC package can be placed in said recess with the said one side facing downward and so that the IC terminals can be supported by said wall.

12. The IC handling system according to claim 11 wherein the IC packages to be handled have terminals which are bent so that their ends are substantially coplanar with the said one side of said IC package and wherein said walls are relatively narrow so that the terminal ends rest on the stage platform surface outside of said walls.

13. The IC handling system according to claim 1 wherein the means for loading and unloading IC packages on and off said stage platform comprise arm members having suction means for lifting said IC packages.

* * * * *